United States Patent [19]

Dejean

[11] Patent Number: 4,497,126

[45] Date of Patent: Feb. 5, 1985

[54] GREETING CARD WITH ILLUMINATED MESSAGE AND DESIGN

[76] Inventor: Rodrigue Dejean, 2220 Fillmore St., Apt. 104, Hollywood, Fla. 33020

[21] Appl. No.: 597,696

[22] Filed: Apr. 6, 1984

[51] Int. Cl.[3] ..... G09F 1/00

[52] U.S. Cl. ..... 40/124.1; 40/152.2; 40/582

[58] Field of Search ..... 40/124.1, 152.2, 540, 40/902, 582, 442; 446/147, 485; 362/98, 155

[56] References Cited

U.S. PATENT DOCUMENTS

| | | | |
|---|---|---|---|
| 2,607,145 | 8/1952 | Pope | 40/563 |
| 2,826,844 | 3/1958 | Leika | 40/152.2 |
| 3,522,426 | 8/1970 | Franc | 362/189 |
| 3,588,491 | 6/1971 | Franc | 362/200 |
| 3,740,543 | 6/1973 | Franc | 446/147 |
| 3,834,051 | 9/1974 | Barnes | 40/582 |
| 4,209,824 | 6/1980 | Kaufman | 40/902 |
| 4,266,164 | 5/1981 | Schroeder | 250/221 |
| 4,286,399 | 9/1981 | Funahashi | 40/152.2 |
| 4,299,041 | 11/1981 | Wilson | 40/124.1 |
| 4,363,081 | 12/1982 | Wilbur | 362/98 |

*Primary Examiner*—Robert Peshock
*Assistant Examiner*—Cary E. Stone
*Attorney, Agent, or Firm*—Oltman and Flynn

[57] ABSTRACT

Greeting card with two folding pages joined by a fold having on one page a raised hollow design containing a battery and a light source and a suitably shaped reflector behind the light source, so that light rays may be reflected onto a reflective message or greeting on the opposite page. A folding light switch is attached to the two opposite pages so that, when the greeting card is opened, the light source is activated and illuminates the reflecting message. The reflective ink used for the message may also contain fluorescent pigment for enhanced visual impression in light containing ultraviolet light.

13 Claims, 5 Drawing Figures

FIG. 1
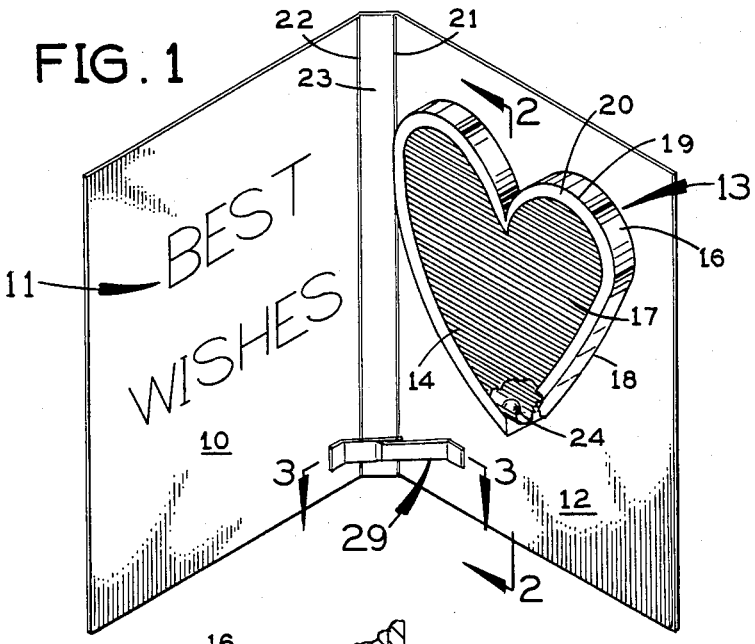
FIG. 2
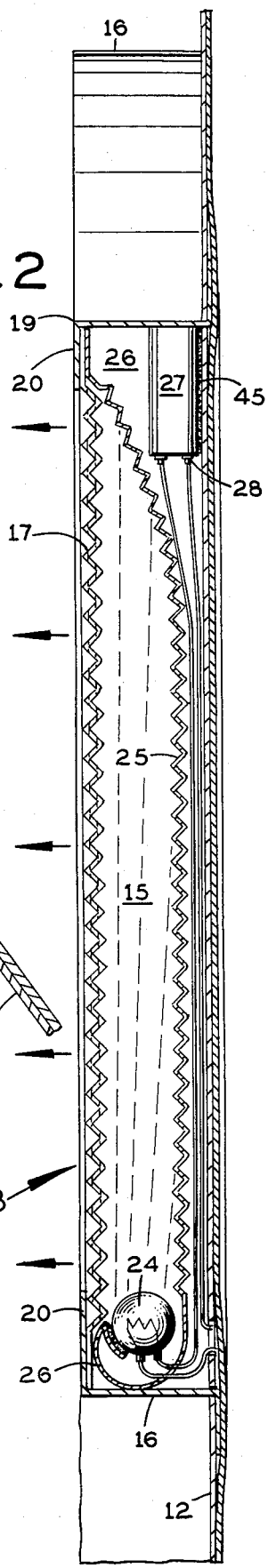
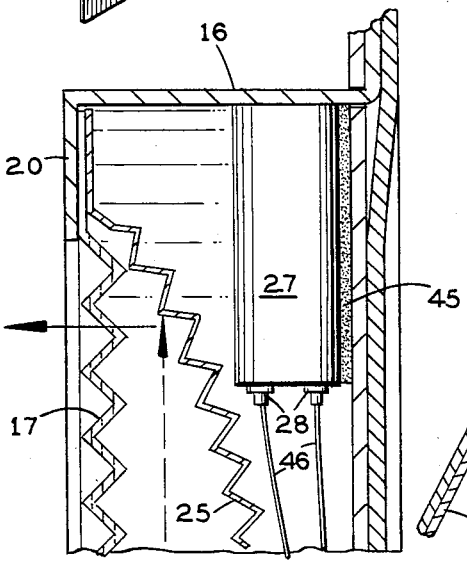
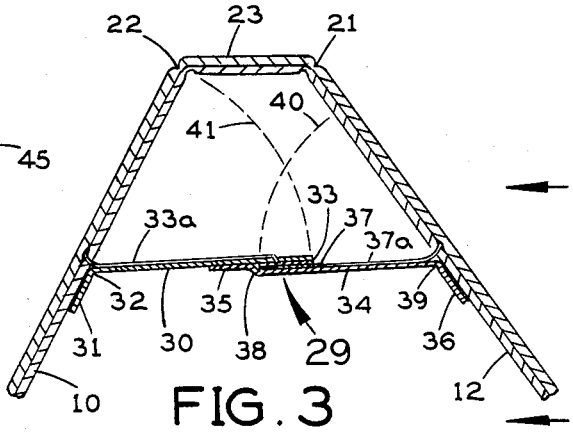
FIG. 3
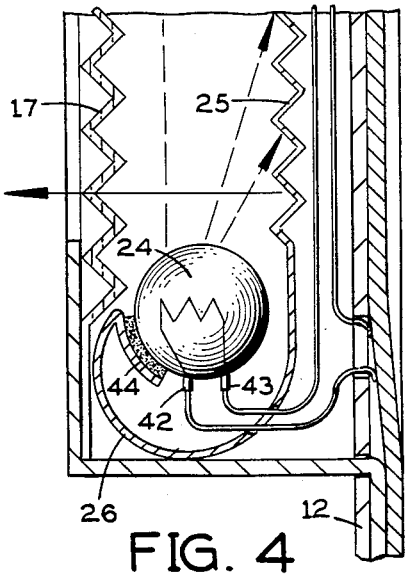
FIG. 4
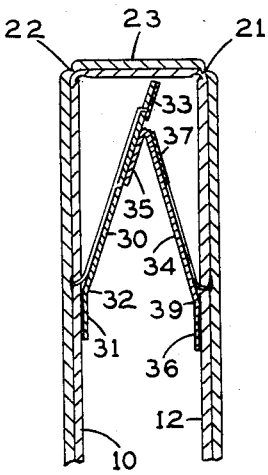
FIG. 5

GREETING CARD WITH ILLUMINATED MESSAGE AND DESIGN

BACKGROUND OF THE INVENTION

The invention relates to greeting cards with a printed message and more particularly to special effects printed greeting cards.

Since the introduction of the greeting card of the type that brings a special printed message to the card's receiver, more elaborate types of greeting cards have been introduced that not only bring a special printed message but also have special effects, such as folded three dimensional panorama that pop out as the card's opened, and others. The present invention discloses a special effect greeting card that provides built-in illumination for a printed message as the card is opened.

PRIOR ART

Other inventors have disclosed greeting cards with built-in illuminating elements.

U.S. Pat. No. 4,363,081 by Wilbur discloses an illuminated greeting card having LED'S connected to a sliding contact on the card.

U.S. Pat. No. 4,299,041 by Wilson discloses a greeting card having electronic animated designs that are activated when the card's opened. U.S. Pat. No. 4,266,164 by Schroeder discloses an electroluminescent panel assembly with a writing surface.

U.S. Pat. No. 3,740,343 by Franc discloses a greeting card with an electrically illuminated ornament that is activated by pulling a tab on the card.

U.S. Pat. No. 3,588,491 also by Franc discloses an illumination unit containing a battery, a lamp and a switch for illuminating a transparent decorative design.

U.S. Pat. No. 3,522,426 also by Franc discloses a disposable power source with a flat battery connected through a switch to miniature lamps.

U.S. Pat. No. 2,607,145 by Pope discloses an illuminated greeting card containing a small battery, a lamp, a switch and a three dimensional illuminated panorama.

SUMMARY OF THE INVENTION

The present invention discloses a special effect greeting card that provides a combination of a decorative luminous design that has a thickness sufficient to contain a small battery connected to an electric lamp through a switch that activates the lamp when the card is opened. The luminous design is disposed on one inner card surface and a reflective written or printed greeting or message on the opposite inside card surface that is illuminated by the luminous design when the card is opened. The luminous design contains elements of low profile such as reflectors and lenses that serve to direct the light rays from the lamp forward to the reflective written or printed message so that the lighted design illuminating the message or the greeting together combine to produce a pleasant, surprising effect when the card is opened by its receiver.

It is therefore an object of the invention to produce a greeting card that is quite thin yet provides enough radiated light from a lamp combined with a luminous design which includes reflectors and lenses to illuminate a message or greeting printed or written in reflective characters by means of a small, flat battery and a small light bulb that is activated when the card is opened and yet can be produced at such a low cost that it can be economically fabricated as a greeting card or novelty item.

Further objects and advantages of this invention will be apparent from the following detailed description of presently preferred embodiments which are illustrated schematically in the accompanying drawings.

BRIEF DESCRIPTION OF THE DRAWINGS

FIG. 1 is a perspective vertical view of a greeting card according to the invention showing a reflective message on the left hand side and a luminous design on the right hand side;

FIG. 2 is an elevational cross-sectional edge view of the luminous design showing its interior construction seen along the line 2—2 of FIG. 1;

FIG. 3 is a top-down, enlarged, cross-sectional detailed view of the lamp switch for activating the lamp circuit seen along the line 3—3 of FIG. 1 in partially activated position;

FIG. 4 is an elevational cross-sectional frag-mentary detailed view of the luminous design, showing the battery, lamp, a reflector and lens seen from the edge; and FIG. 5 is a top-down cross-sectional fragmen-tary detail view of the lamp switch of FIG. 3 in the folded inactive position.

Before explaining the disclosed embodiments of the present invention in detail it is to be understood that the invention is not limited in its application to the details of the particular arrangements shown, since the invention is capable of other embodiments. Also, the terminology used herein is for the purpose of description and not of limitation.

DETAILED DESCRIPTION OF THE PREFERRED EMBODIMENTS

FIG. 1 shows the left and right hand inside pages of a greeting card according to the teachings of the invention in the partially opened condition. The left hand page 10 shows a message "Best Wishes", generally at 11, composed of characters that are preferably light reflec-tive so that the message shows bright and clear, even in reduced ambient light. For this purpose the message may be printed or written with any one of many available and well known types of ink that is reflecting either due to metallic grains or flakes contained therein, or by any other suitable method for applying reflective characters, such as by cutting them from a reflective material and adhesively attaching them to the card surface. It is also to be understood that the concept embraced by the term reflective message may also comprise a message composed of non-reflective ink or material applied to the characters and lines while the background is contrastingly reflective. The reflectivity of the characters or the contrasting background may further be understood to embrace inks or materials treated with fluorescent pigment that provide enhanced brilliancy, when exposed to light of wavelengths shorter than ordinary visible light. Such fluorescent pigments that produce a strong visual impression when exposed to light rays containing ultraviolet light are well known. (See e.g. Encyclopedia of Science & Technology, McGraw Hill Vol. 5, p.347).

The right hand inside surface 12 of the card shows a raised hollow design 13 showing as an example a heart symbol, but the design may express any other desired idea such as a Christmas tree, a birthday cake, a bouquet of flowers or anything else as desired. Any design chosen will have an inner "window" 14 covered with a transparent or translucent lens 17 that will admit light from the inside space 15 (FIG. 2) of the hollow design 13. The design 13 has a perimeter 16 that defines the outline of the design and supports the lens 17. The perimeter 16 is made from a suitable reasonably strong, flexible, thin material such as cardboard or plastic in the form of a strip that follows the outer contour of the design. The strip is attached by suitable means such as adhesive bonding or the like at one edge 18 to the right hand surface 12 of the card and projects from the surface in an direction, generally perpendicular to the surface 12 of the card. An optional flange 20 in a plane generally parallel with the card surface 12 is attached at its outer edge to the upstanding edge 19 of the strip 16 and projects radially inward toward the general center area of the design and also follows the contour of the design. The flange 20 serves generally a decorative purpose but may also serve to retain the lens 17. It follows that the flange 20 could be widened and cover a greater part of the lens 17 and may have decorative holes and cutouts as desired by the card designer.

The strip 16 and the flange 20 define a generally planar interior space 15 of the hollow design 13.

The two card surfaces 10 and 12 are made by common cardboard or similar material that are folded along two vertical parallel folds 21 and 22, that are separated by a vertical back strip 23 of a width generally equal to the width of the strip 16 defining the contour of the design 13. The back strip 23 allows the card sides 10 and 12 to be folded together to a parallel position in which the card is closed, (FIG. 5).

The interior hollow space 15 of the design 13 contains components for illuminating the design and for projecting light onto the reflecting message 11.

The illuminating components consist of one or more incandescent light bulbs 24 located inside the design in one or more suitable locations, from where the bulbs, when energized, can project light rays against a suitably shaped reflector 25 disposed inside the design 13. In the exemplary design shaped like a heart shown in FIG. 1, the location of the bulb 24 has been chosen as the lower "tip" of the heart design concealed behind the flange 20, and cradled in the lower forward rolled edge 26 of the reflector 25. The inside leftward facing surface of the reflector 25, seen from the edge in FIG. 2, is of a polished, reflecting material, such as polished aluminum foil or tin plated foil. The reflector preferably is rippled with ripples generally horizontally oriented so that light rays from the bulb, as they are shining upward, are reflected from the ripples to the left as shown by the arrows. The surface may, alternatively, instead of being rippled have a "crushed" irregular or a pitted surface that may also serve to reflect the light from the bulb 24 generally to the left, but generally dispersed. As seen in FIG. 2, the reflector 25 extends upward and slopes generally forward from a point behind the bulb 24 so that it is in the best possible orientation for reflecting the light toward the left. The front of the design 13 is covered generally by a lens 17 that fills the window 14. The lens 17 further serves to transmit the light rays reflected from the reflector 25 and is therefore made from a translucent suitable plastic material. The lens 17 may be rippled like the reflector 25 and may further aid in catching and directing the reflected light rays toward the message 11. Depending on the artistic objectives, the lens 17 may be made of colored plastic or coated with a colored plastic film. The film may alternatively have one color and the lens material a different color and cutouts in the lens or the film may further be used to create and enhance the artistic effects. The reflector 25, sloping forward, creates a space 26 behind the reflector and in front of the card surface 12, which contains a small dry-cell battery 27 with terminals 28. The battery 27 is attached to the surface of the card by adhesive bonding or any other suitable means. The battery may suitably be of the conventional 1.5 volt type, and preferably, of a low profile. A battery of thin configuration is widely used for electronic watches, radios and the like. The terminals 28 are wired to the light bulb 24 through a folding light switch 29, which has contacts that close when the card is opened, and complete the electric circuit from the battery 27 to the bulb 24.

Since it is an important object of the invention to keep its cost as low as practical compared with its contemplated use as a novelty item, the light switch 29 is made of stiff cardboard or fiber board pieces with creases and tabs that are adhesively and inexpensively attached to the card surfaces. FIG. 3 shows the details of one method of construction of the light switch, seen in a top-down edge view in the partially open position. FIG. 5 shows the switch seen in the card-closed position with the card 16 in the completely folded position.

The folding light switch 29, referring now to FIGS. 3 and 5, consists of a long pivot arm 30, and a short pivot arm 34 wherein the long pivot arms 30 is attached to the left cardboard surface 10 at a tab 31 and pivots in the viewing plane about the pivot point 32, and has a metallic contact point 33 at the distal end disposed away from the pivot point 32 on the outward facing side of the pivot arm 30. The short pivot arm 34 is attached to the right cardboard side 12 at the tab 36 and to the long pivot arm at tab 35, on the long pivot arm generally one- third of its length from its distal end. The short pivot arm 34 has a first pivot point 38 between the tab 35 and the arm proper, and a second pivot point 39 between the arm proper and the tab 36. As stated above, as the greeting card is opened, the two contact points 33 and 37 approach each other and make electric contac when the card is fully opened. Conversely, when the card is folded, the two switch arms pivot about their pivot points and the contact points 33 and 37 move apart from each other. The two arcuate phantom lines 40 and 41 show the trajectory of the ends of the two pivot arms as the card is closed from the position shown in FIG. 3. In the closed position shown in FIG. 5, the long pivot arm 30 is positioned at an angle with and adjacent the left card side 10, while the short pivot arm 34 similarly is in a diagonal position between its tab 36 attached to the right side 12 of the card and its tab 35 attached to the right side 12.

It follows that other types and embodiments of the folding switch 29 may be devised. One such other embodiment employs a string attached to one card side attached to a movable contact point on the other card side, which makes contact with an opposite fixed contact point when the card is opened.

The contact points 33 and 37 are each connected with an electric lead to the series connected light bulb 24 and battery terminals 28 so that when the card is opened and the contact points make contact, the light bulb 24 will light up.

The electric leads **33*a* and 37*a*** from the contact points will, for aesthetic reasons, preferably be concealed so as not to detract from the artistic appearance of the greeting card. The leads may therefore be placed on the backside of the card placed under adhesive tape for protection or concealed between two layers of cardboard.

The construction of the components of the greeting card according to the invention, is, as described above, such that the least expensive yet workable construction methods is followed. As seen on FIG. 4, therefore, the light bulb is preferably of a type not having the usual light bulb base, but instead two wires 42 and 43, exiting from the glass envelope of the bulb, which are then soldered directly to the connecting leads. The epoxy cement or the like attached to the bottom part 26 of the reflector 25, and the battery similarly is attached to the inside right card surface 12 by means of a small dot 45 of epoxy or the like. The terminals 28 may be connected by soldering to the connecting leads 46.

It should be noted that the raised design 13 need not consist of a single figure as described above, but may take any possible form that is capable of artistically expressing a sentiment. As examples, it may consist of one, two or several raised parts, each or some of them containing, if desired, an electric light bulb and a reflector and a lens, as described above.

The card construction may embrace further artistic elements such as means for flashing the light, and if several light bulbs are provided, one or more may be connected to flashing circuit components, or the electric light bulb proper may contain means for flashing the light, in a well known manner.

The greeting card, according to the invention, is described above having one or more incandescent light bulbs. It should be understood that other light emitters are available and may be used in the construction of the card. Well known light emitters are for example the so-called Light-Emitting Diodes (LED) which employ a diferent light-emitting method based on semiconductor operation. Such LED'S may be used alone or in combination with one or several incandescent light bulbs and energized by the same battery 27 and light switch 29. LED'S normally require a current limiting resistor when operated from a single battery. The current limiting resistor may be provided by the means of using very thin connecting wires between the components of the card which further aids in the concealment of the wires.

I claim:

1. A greeting card with illuminated design and reflective message comprising:

a folding card having at least a first and a second inside surface joined by at least one fold;

at least one raised design having an interior design space and a window attached to said first inside surface;

a reflective message attached to said second inside surface;

a folding light switch operatively attached to said first and second inside surfaces;

at least one electric light source disposed inside said raised interior design space;

a reflector for reflecting light from said light source onto said reflective message;

an electric battery;

wiring for interconnecting said folding light switch, said light source and said battery, said wiring constituting an electrical circuit;

said folding light switch operating to activate said light source when said card is opened along said fold.

2. A greeting card according to claim 1 wherein:

said raised design further comprises a perimeter strip of a finite width and having first and second substantially parallel edges;

said perimeter strip attached along said first edge to said first inside surface and projecting away from said first surface, said second edge of said strip defining said design window, said perimeter strip and said window and said first inside surface defining said interior design space;

said interior space containing said electric battery and said light source.

3. A greeting card according to claim 2 wherein said reflector is generally planar and has a reflecting surface facing said window and disposed behind said electric light source and reflecting light rays from said light source through said window onto said reflective message.

4. A greeting card according to claim 3 wherein said reflecting surface is a rippled reflecting surface.

5. A greeting card according to claim 3 and further comprising:

a lens;

said lens disposed anterior to said reflector and operating to direct said light rays onto said reflective message.

6. A greeting card according to claim 3 wherein said reflector is disposed substantially dia-gonally through said interior space and dividing said space into an anterior space and a posterior space, said anterior space bounded by said reflecting surface, wherein said anterior space further contains said light source.

7. A greeting card according to claim 6 wherein said posterior space contains said battery.

8. A greeting card according to claim 1 wherein said folding light switch further comprises:

a long pivot arm having a tab attached by a pivot point to said long pivot arm, said tab further attached to said second inside surface, a first contact point attached to said long pivot arm and spaced apart from said pivot point;

a short pivot arm having first and second ends, and a first and second tabs attached to said first and second ends respectively, through first and second pivot points, said second tab attached to said long pivot arm between said first contact point of said long pivot arm and said first tab, said short pivot arm attached to said first inside surface by said first tab, said second contact point coordinated with said first contact point such that said contacts operate to complete said electrical circuit when said card is opened.

9. A greeting card according to claim 1 wherein said reflective message comprises reflecting ink.

10. A greeting card according to claim 9 wherein said reflective message further comprises a background, said background contrasting with said reflecting ink.

11. A greeting card according to claim 9 wherein said reflective message further comprises fluorescent pigment.

12. A greeting card according to claim 1 wherein said electric light source comprises an incandescent lamp.

13. A greeting card according to claim 1 wherein said light source comprises a light-emitting diode.

* * * * *